US008491177B2

(12) United States Patent
Klages et al.

(10) Patent No.: US 8,491,177 B2
(45) Date of Patent: Jul. 23, 2013

(54) HIGH-PRESSURE DISCHARGE LAMP

(75) Inventors: Kilian Klages, Berlin (DE); Karsten Pietsch, Berlin (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 0 days.

(21) Appl. No.: 13/262,300

(22) PCT Filed: Mar. 3, 2010

(86) PCT No.: PCT/EP2010/052666

§ 371 (c)(1),
(2), (4) Date: Sep. 30, 2011

(87) PCT Pub. No.: WO2010/112289

PCT Pub. Date: Oct. 7, 2010

(65) Prior Publication Data

US 2012/0019142 A1 Jan. 26, 2012

(30) Foreign Application Priority Data

Mar. 30, 2009 (DE) ..... 10 2009 015 572

(51) Int. Cl.
*H01R 33/00* (2006.01)

(52) U.S. Cl.
USPC ..... 362/640; 362/257; 362/368

(58) Field of Classification Search
USPC ..... 362/640, 647, 655, 656, 657, 658, 362/659, 257, 362, 368
See application file for complete search history.

(56) References Cited

U.S. PATENT DOCUMENTS

| | | | |
|---|---|---|---|
| 5,879,073 | A | 3/1999 | Hori et al. |
| 6,239,539 | B1 | 5/2001 | Mochiduki et al. |

FOREIGN PATENT DOCUMENTS

| | | |
|---|---|---|
| DE | 101 63 377 | 7/2003 |
| DE | 10 2007 022 028 | 11/2008 |
| EP | 0 975 007 | 1/2000 |
| EP | 1 503 138 | 2/2005 |
| JP | 11-176543 | 7/1999 |
| JP | 2005 294110 | 10/2005 |
| JP | 2008 159509 | 7/2008 |
| WO | WO 00/59296 | 10/2000 |
| WO | WO 2005/008125 | 1/2005 |
| WO | WO 2008/110969 | 9/2008 |

*Primary Examiner* — Vip Patel
(74) *Attorney, Agent, or Firm* — Cozen O'Connor

(57) ABSTRACT

A high-pressure discharge lamp comprising a translucent lamp bulb (1), which extends along a longitudinal axis of the lamp and is attached to a plastic base (2; 302), which is essentially surrounded by a metal shielded enclosure (4; 104), a metal reference ring (8; 208; 308), which is attached to an inner base part (6; 106; 306) of the plastic base (2; 302), and can is adapted to be brought into contact with a lamp module or vehicle headlight, wherein the reference ring (8; 208; 308) has at least one contact section (16; 216; 316), which is in electroconductive contact with the shielded enclosure.

19 Claims, 7 Drawing Sheets

HIGH-PRESSURE DISCHARGE LAMP

RELATED APPLICATIONS

This is a U.S. national stage of application No. PCT/EP2010/052666, filed on Mar. 10, 2010.

This application claims the priority of German application no. 10 2009 015 572.4 filed Mar. 30, 2009, the entire content of which is hereby incorporated by reference.

FIELD OF THE INVENTION

1. Technical Field

The invention relates to a high-pressure discharge lamp.

2. Background of the Invention

High-pressure discharge lamps, which are employed in vehicle headlights, have a lamp bulb, which is housed on one side in a plastic base and is fixed there. The base is accommodated in the vehicle headlight.

Lamps of this kind must have electromagnetic compatibility, which is achieved by means of metal shielding. The bases of the lamps thus have a metal shielded enclosure, which must be brought into electroconductive contact with the vehicle headlight via transition pieces (for example metal brackets or spirals), which are in some cases costly.

Such a high-pressure discharge lamp is for example disclosed in WO 00/59269 or in WO 2005/008125 A1.

SUMMARY OF THE INVENTION

One object of the present invention is to provide a high-pressure discharge lamp, the shielding of which together with a lamp module or together with a vehicle headlight is simplified.

One embodiment of a high-pressure discharge lamp according to the invention has a translucent lamp bulb, which extends along a longitudinal axis of the lamp and is attached to a plastic base, which is essentially surrounded by a metal enclosure. The metal enclosure serves to provide electromagnetic shielding for the electrical components of an igniter for ignition of the gas discharge in the lamp bulb of the high-pressure discharge lamp arranged in the interior of the plastic base. This metal enclosure will hereinafter be referred to as a shielded enclosure. The high-pressure discharge lamp furthermore has a metal reference ring, which is attached to an inner base part of the plastic base, and which can be brought into contact with a lamp module or vehicle headlight, wherein the reference ring has at least one contact section, which is in electroconductive contact with the shielded enclosure. An electrical connection from the shielded enclosure via the contact section and the metal reference ring to the lamp module or vehicle headlight respectively is thereby created and thus a shielding simplified compared with the prior art provided. Here, the metal reference ring on the one hand has the mechanical reference surface between the high-pressure discharge lamp and the vehicle headlight and on the other hand forms the electrical connecting piece between the shielded enclosure and the vehicle headlight, so that the manufacturing effort for the high-pressure discharge lamp is reduced. In addition, the metal reference ring shields the inner base part against UV radiation from the arc ignited in the lamp bulb, so that outgassings are sharply reduced.

It is here particularly preferable if the contact section extends approximately radially outwards relative to the longitudinal axis of the lamp and has a contact surface, which is in electroconductive contact with the shielded enclosure.

For optimization of the electromagnetic shielding the shielded enclosure is advantageously connected to an electrical ground potential, for example with the internal ground reference potential of an operating circuit for the high-pressure discharge lamp.

In a first preferred development of the inventive high-pressure discharge lamp, the contact section is at least in parts overmolded by the inner base part. The contact section thus additionally serves to fix the reference ring on the inner base part.

In another preferred development of the inventive high-pressure discharge lamp, the contact section is at least in parts set into a flat recess of the plastic base. This permits the reference ring firstly to be simply mounted on the inner base part, and the shielded enclosure can then be mounted on and brought into electroconductive contact with the contact section.

At least one contact bracket is preferably provided for secure contact and fastening of the contact section, which has an intermediate section arranged approximately parallel to the longitudinal axis of the lamp, wherein a contact section is provided on each contact bracket.

For secure fixing/supporting of the lamp bulb on the inner base part, it is preferable if metal welding lugs are embodied on the reference ring, whose end sections are welded with a metal spring clip surrounding the lamp bulb.

For secure attachment of the reference ring on the inner base part, it is preferable if the reference ring has mounting lugs, which are arranged approximately parallel to the longitudinal axis of the lamp and are at least in parts overmolded by the inner base part.

For reasons of simple symmetrical manufacture of the reference ring and an even distribution of force between lamp bulb, vehicle headlight and base, the reference ring can have four welding lugs and four mounting lugs, which are arranged evenly and in each case in pairs at the same points on the periphery of the reference ring. Furthermore, the reference ring can have three contact brackets and an additional intermediate section. The protective Faraday cage is thus closed.

For reasons of simple manufacture of the reference ring, it is preferable if this is a stamp-bent part, whose contact brackets are embodied by bending outwards away from the direction of the lamp bulb, whose welding lugs are embodied by bending outwards away from the direction of the lamp bulb, and whose mounting lugs and whose additional intermediate section are embodied by bending inwards away from the direction of the lamp bulb.

In an advantageous embodiment the shielded enclosure has one half of the enclosure facing towards the lamp bulb and one facing away from the lamp bulb, wherein the contact surfaces, which are arranged on the outer end section of the side of each contact section facing towards the lamp bulb, are in contact with the half of the enclosure facing towards the lamp bulb.

In another advantageous embodiment the inner base part has a flange arranged approximately perpendicular to the longitudinal axis of the lamp in, for example, square form, which is riveted to the shielded enclosure, wherein each contact section is arranged on the side of the flange facing away from the lamp bulb, and wherein the contact surfaces are provided on the side of each contact section facing away from the lamp bulb. A high-pressure discharge lamp is thus created, whose inventive electrical contacts can be created upon mounting of the flange on the shielded enclosure and secured in place by riveting.

In alternative exemplary embodiments of the inventive high-pressure discharge lamp, in order to support the lamp bulb against the base, and to ensure even transmission of forces, 4 metal welding lugs are evenly distributed and fixed around the periphery of the inner base part, which extend from the inner base part in the direction of the lamp bulb, and whose end sections are welded with a metal spring clip surrounding the lamp bulb.

Accordingly, for unhindered assembly of the reference ring it is preferable if 4 recesses are evenly arranged on the inner rim of the reference ring, through which the welding lugs extend from the inner base part to the metal spring clip.

In an advantageous embodiment the reference ring has a spacer ring on its outer rim and on its side facing away from the glass bulb, on the rim of which facing away from the lamp bulb are evenly distributed and fixed a multiplicity of bent brackets. Each bent bracket engages behind a surrounding projection of the inner base part with a rear grip section directed approximately radially inwards. Furthermore, each bent bracket has an intermediate section running approximately parallel to the longitudinal axis of the lamp and connecting to the rear grip section, and a contact section directed approximately radially outwards and connecting to the intermediate section. With these bent brackets it is possible to guarantee secure fixing of the reference ring to the inner base part and at the same time a durable electrical connection to the shielded enclosure.

In another advantageous embodiment the reference ring has at least one clip fastening, which has an intermediate section arranged approximately parallel to the longitudinal axis of the lamp and a rear grip section directed approximately radially inwards and connected thereto, which engages behind a supporting section of the inner base part. The reference ring here preferably has 2 clip fastenings on oppositely located peripheral sections and the inner base part accordingly 2 supporting sections. The reference ring can furthermore have a contact bracket arranged between the clip fastenings, which has an intermediate section arranged approximately parallel to the longitudinal axis of the lamp and a contact section directed approximately radially outwards connected thereto. By means of the two clip fastenings, a particularly simply effected attachment of the reference ring on the inner base part is provided for.

The second variant of the inventive high-pressure discharge lamp likewise has a translucent lamp bulb, which extends along a longitudinal axis of the lamp and is attached to a plastic base, which is essentially surrounded by a metal shielded enclosure. Here a metal contact collar is provided on the shielded enclosure, which can be brought into electroconductive contact with a lamp module or vehicle headlight. An electrical connection from the shielded enclosure to the lamp module or vehicle headlight respectively via the contact collar, and thus a metal shielding is created which is simplified relative to the prior art.

In a preferred development, the contact collar is arranged on the periphery of an opening of the shielded enclosure penetrated by an inner base part of the plastic base.

In a particularly preferred development the contact collar 12 has projections evenly distributed on the periphery of the contact collar, which in each case have a triangular form and extend radially outwards.

For reasons of compatibility of the inner base part it makes sense if it complies with the Standard IEC 60061-1 PREFOCUS CAPS PK32d as mentioned in the ECE Regulation No. 99.

In order to achieve defined bearing points and a non-tipping power transmission between the inventive high-pressure discharge lamp and the lamp module or vehicle headlight respectively, bearing cams according to the Standard IEC 60061-1 PREFOCUS CAPS PK32d are preferably evenly distributed on the reference ring 3 periphery, which can be brought into contact with the lamp module or vehicle headlight.

BRIEF DESCRIPTION OF DRAWINGS

The invention is explained in greater detail below on the basis of exemplary embodiments, wherein.

DETAILED DESCRIPTION OF THE DRAWINGS

Figure 1:
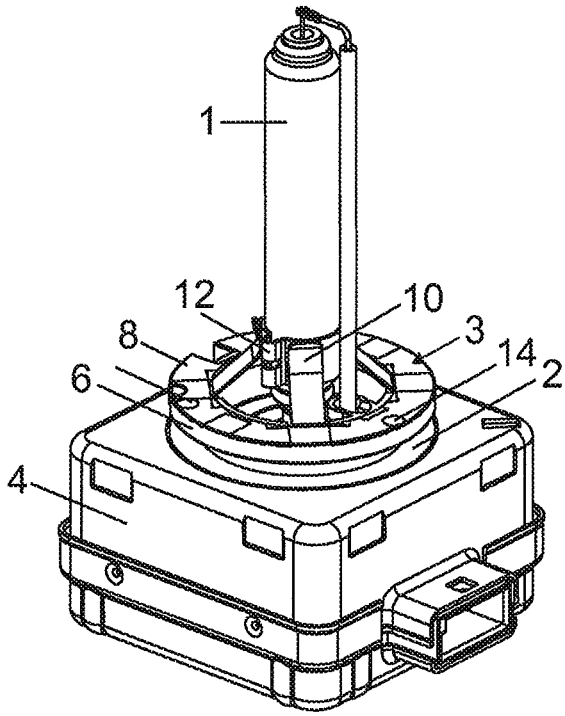
FIG. 1 shows a first exemplary embodiment of an inventive high-pressure discharge lamp in a perspective view.

FIG. 1 shows a first exemplary embodiment of an inventive high-pressure discharge lamp in a perspective view. This lamp takes the form of a halogen metal vapor high-pressure discharge lamp with an electrical power input of approx. 35 Watts, which for example serves as the light source in a vehicle headlight. It has essentially one translucent lamp bulb 1, which comprises a discharge vessel made of quartz glass and a glass outer bulb surrounding the discharge vessel, and is accommodated in a plastic base 2. The plastic base 2 is here approximately square in shape, and largely surrounded by a metal shielded enclosure 4. This shielded enclosure 4 serves to provide electromagnetic compatibility (EMC) of the electrical and electronic devices which are accommodated in the plastic base 2 and serve in particular to ignite the arc in the lamp bulb 1. In the interior of the plastic base 2 are housed at least the components of a pulse ignition device for igniting the gas discharge in the lamp bulb 1 or in the discharge vessel of the high-pressure discharge lamp respectively. In addition the electrical components of an operating device for the high-pressure discharge lamp can also be arranged in the interior of the plastic base 2.

On the top (in FIG. 1) of the shielded enclosure 4 a circular opening is provided, through which the plastic base 2 and in particular its inner base part 6 extend.

In the inner base part 6, which corresponds to the IEC 60061-1 PREFOCUS CAPS PK32d Standard, an end section of the lamp bulb 1 is accommodated. The inner base part 6 is here largely constructed in circular cylindrical firm, wherein in FIG. 1 only its upper end section is visible.

According to the invention a metal reference ring 8 is fixed to the upper rim of the inner base part 6 (in FIG. 1). The reference ring 8 has four welding lugs 10, which are arranged evenly on the inner rim of the reference ring 8 and are inclined in the direction of the lower end section of the lamp bulb 1. A number of recesses are furthermore provided on the reference ring 8, which are explained with reference to the following figures.

The free end sections of the four welding lugs are welded with a metal spring clip 12, which firmly encloses the lower end section of the lamp bulb 1. This arrangement serves to secure the lamp bulb 1 against the base 6, 2.

On its top (in FIG. 1), the reference ring has bearing cams 14 evenly distributed on the periphery, which form three non-tipping defined contact points with a lamp module (not shown) or vehicle headlight, in which the inventive high-pressure discharge lamp is set.

Figure 2:
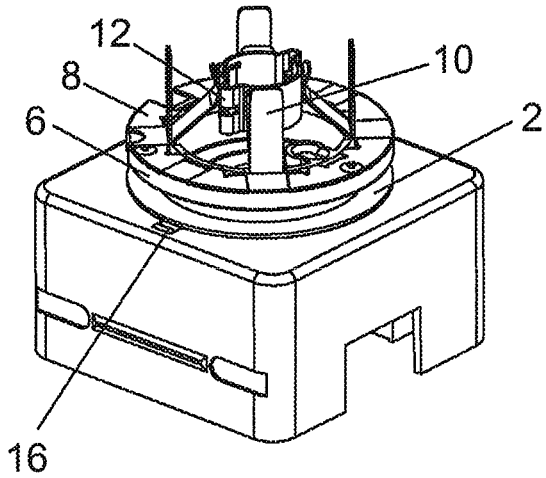
FIG. 2 shows part of the first exemplary embodiment according to FIG. 1 in an intermediate step of the manufacture in a perspective view.

FIG. 2 shows the first exemplary embodiment according to FIG. 1 in an intermediate manufacturing step in a perspective view. The inner base part 6, the plastic base 2 and the inventive metal reference ring 8 are here shown with the lamp bulb 1 and the shielded enclosure 4 not yet mounted.

The reference ring 8 has the four welding lugs 10, which in the state shown in FIG. 2 have not yet been bent into their final position and are not yet welded with the metal spring clip 12. Unlike in the prior art the welding lugs 10 are formed in one piece with the reference ring 8.

The reference ring 8 furthermore has three contact sections 16, of which only one contact section 16 is represented in FIG. 2. The two other contact sections 16 are in each case arranged offset at 90° to the periphery of the reference ring 8.

According to the invention, the metal reference ring 8 is overmolded by the inner base part 6, which is made of plastic, wherein the embedding of the reference ring 8 in the inner base part 6 is explained with reference to FIG. 4.

The three contact sections 16, which are formed in one piece with the reference ring 8, are positioned in such a way that they come into electroconductive contact with the shielded enclosure 4, when this is mounted on the plastic base 2 (cf. FIG. 1). When the mounted high-pressure discharge lamp according to FIG. 1 is inserted into the lamp module (not shown), the metal bearing cams 14 come into electroconductive contact with this. According to the invention a Faraday cage is thus created, which essentially comprises the shielded enclosure 4 and the lamp module, which are electroconductively connected with each other via the contact sections 16, the metal reference ring 8 and the bearing cams 14.

Figure 3:
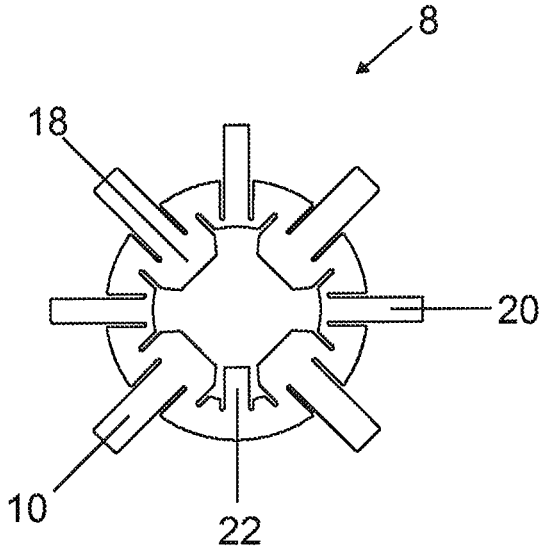
FIG. 3 shows the reference ring of the first exemplary embodiment according to FIG. 1 in an intermediate step of its manufacture, seen from above.

FIG. 3 shows the reference ring 8, which is stamped out of sheet metal in a mold. Four mounting lugs 18 are provided here, which are distributed evenly on the internal circumference of the reference ring 8 and extend inwards. The width of these mounting lugs 18 is greater than their length, wherein in each case their two free corners are beveled.

From a central position of the section of each mounting lug 18 facing towards the reference ring 8, a welding lug 10 extends radially outwards. Approximately half the length of the welding lug 10 here runs through a recess of the reference ring 8, while the other half of the welding lug 10 is embodied as a free end section.

At four positions, which in each case are arranged between the four welding lugs 10 on the periphery of the reference ring 18, are arranged three contact brackets 20 and an intermediate section 22. The three contact brackets 20 and their attachment to the reference ring 8 are comparable with the welding lugs 10, while the intermediate section 22 extends inwards from the inner rim of the reference ring 8.

Figure 4:
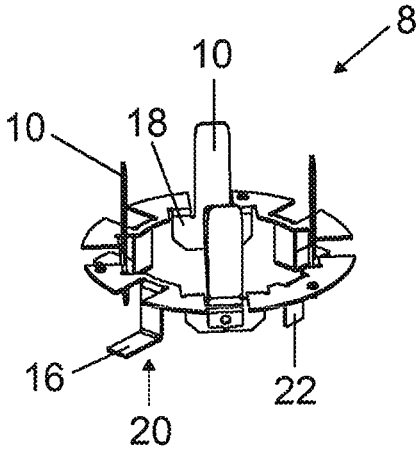
FIG. 4 shows the reference ring of the first exemplary embodiment according to FIG. 1 in a further intermediate step of its manufacture in a perspective view.

FIG. 4 shows the reference ring of the first exemplary embodiment according to FIGS. 1-3 in a later intermediate step of its manufacture. Here, the mounting lugs 18 (in FIG. 1) are bent downwards through 90°, by means of which welding lugs 10 (in FIG. 4) attached thereto take on an upward attitude.

Furthermore, the three contact brackets 20 and the intermediate section 22 are bent downwards by 90°. Finally, the three contact sections 16 of the contact bracket 20 are in turn bent through 90°, so that these extend approximately radial outwards.

In the next step, the reference ring 8 prepared according to the invention in this way can be inserted into the injection mold of the inner base part 6 and there overmolded with plastic in such a way that a hybrid part made up of the plastic inner base part 6 and the metal reference ring 8 emerges (cf. FIG. 2).

Figure 5:
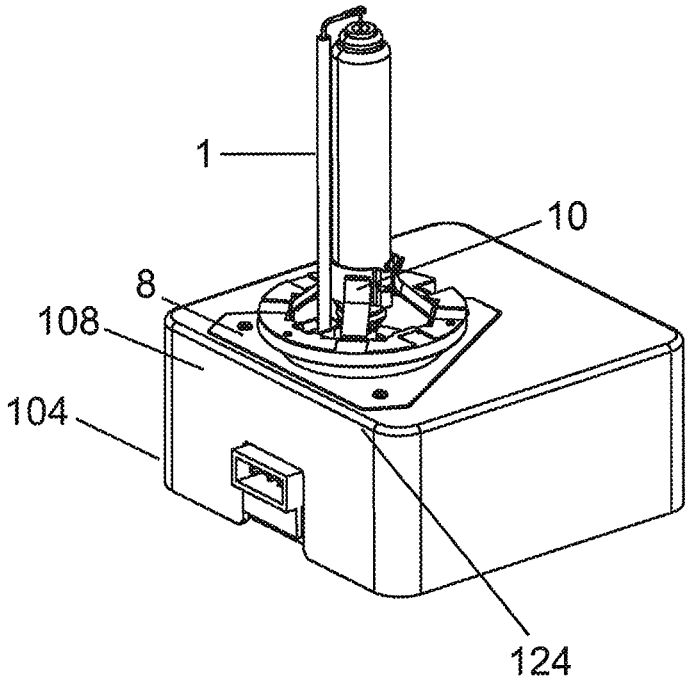
FIG. 5 shows a second exemplary embodiment of an inventive high-pressure discharge lamp in a perspective view.

FIG. 5 shows a second exemplary embodiment of an inventive high-pressure discharge lamp in a perspective view, wherein in this exemplary embodiment too, the reference ring 8 is provided according to the first exemplary embodiment (cf. FIG. 4). FIG. 5 in turn shows a ready-mounted lamp, wherein the inner base part 106 has an approximately square plastic plate 124, which is arranged approximately perpendicular to the longitudinal axis of the lamp.

Figure 6:
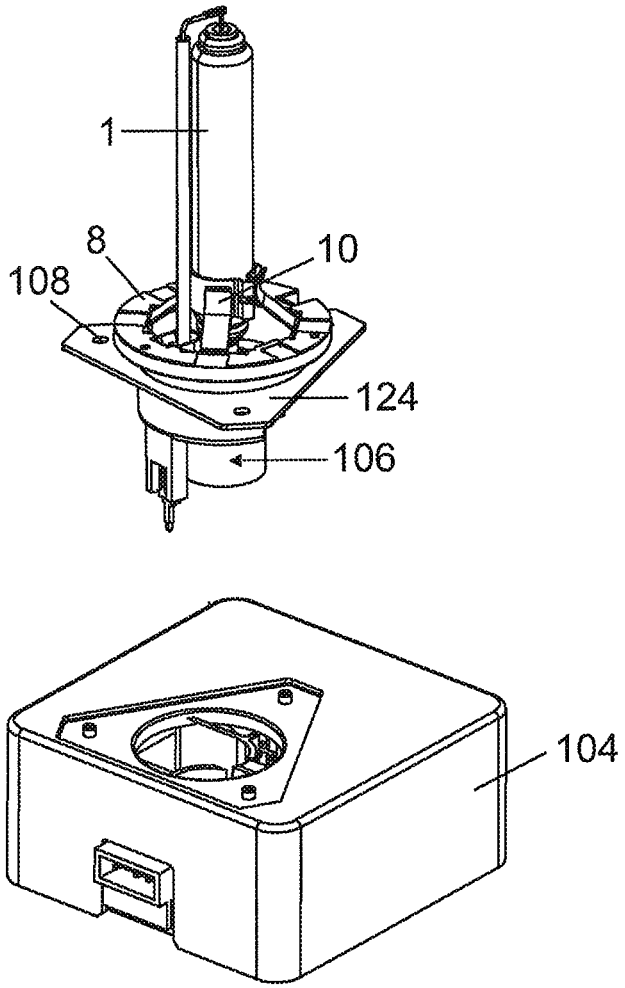
FIG. 6 shows the second exemplary embodiment according to FIG. 5 in an intermediate step of its manufacture in a perspective view.

FIG. 6 shows the second exemplary embodiment according to FIG. 5, wherein the inner base part 106 is represented with the plate 124 outside the shielded enclosure 104.

The metal reference ring 8 is overmolded by the inner base part 106 in such away that its three contact sections 16, of which only two are represented in FIG. 6, lie open on the side of the plate 124 facing away from the lamp bulb 1. According to the second exemplary embodiment the electrical contact between the reference ring 8 and the shielded enclosure 104 is created in that the plate 124 is arranged on the top of the shielded enclosure 104 and fixed there by means of rivets 108. The three contact sections 16 of the contact bracket 20 are in electroconductive contact with the upper surface of the metal shielded enclosure 104.

In this exemplary embodiment the shielded enclosure 104 can be embodied in one piece from a metal material, preferably aluminum, because the inner base part 106 does not determine the main enclosure form, but is rather to be regarded as a sort of base adapter.

Figure 7:
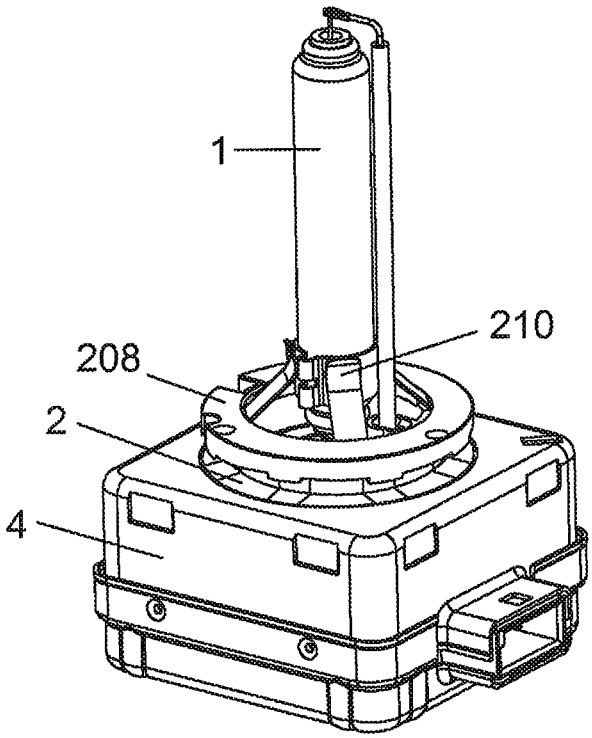
FIG. 7 shows a third exemplary embodiment of an inventive high-pressure discharge lamp in a perspective view.

FIG. 7 shows a third exemplary embodiment of an inventive high-pressure discharge lamp, wherein the shielded enclosure 4 and the plastic base 2 correspond to those of the first exemplary embodiment according to FIGS. 1 and 2. The essential differences of the third exemplary embodiment according to FIG. 7 compared to the exemplary embodiments already described lie in the fact that according to the prior art the four welding lugs 210 are fixed to the inner base part (not shown). Accordingly, a metal reference ring 208 has no welding lugs.

Figure 8:
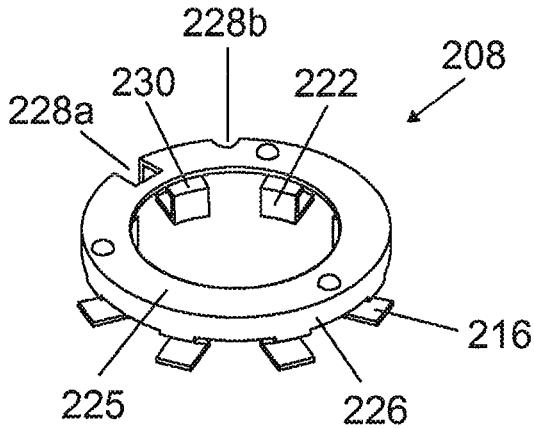
FIG. 8 shows the reference ring of the third exemplary embodiment according to FIG. 7 in a perspective view.

FIG. 8 shows the reference ring 208 of the third exemplary embodiment according to FIG. 7. This has a main section 225 and a spacer ring 226 running round its outer rim.

The reference ring 208 furthermore has a reference groove and coding 228*a*, 228*b*, which are arranged on the outer rim of the main section 225 according to the Standard IEC 60061-1 PREFOCUS CAPS PK32d, and which penetrate the spacer ring 226 in each case as a through-hole.

To fix the reference ring 208 on the inner base part and for its contacting with the shielded enclosure 4, eight bent brackets are provided, evenly distributed on the periphery. They are attached to the rim of the spacer ring 226 facing towards the shielded enclosure 4 and in each case have the following three sections:

A rear grip section 230 extends radially inwards, an intermediate section 222 connected thereto extends (in FIGS. 7 and 8) downwards, and the contact section 216 connected thereto extends radially outwards. The definitive form of the bent bracket shown in FIG. 8 emerges after the reference ring 208 has been mounted on the (in Fig.) upper rim of the inner base part and in particular the rear grip sections 230 of each bent bracket have been bent around a surrounding projection of the inner base part, so that they extend approximately radially inwards. The intermediate sections 222 are then arranged approximately parallel to the longitudinal axis of the lamp, and the contact sections 216 extend in each case radially outwards at the end of the bent bracket.

The shielded enclosure 4 is thereafter mounted on the plastic base 2, wherein the upper surfaces of the contact sections 216 shown in FIG. 8 are at least in parts covered by the top half of the shielded enclosure 4 and thereby come into electroconductive contact.

Figure 9:
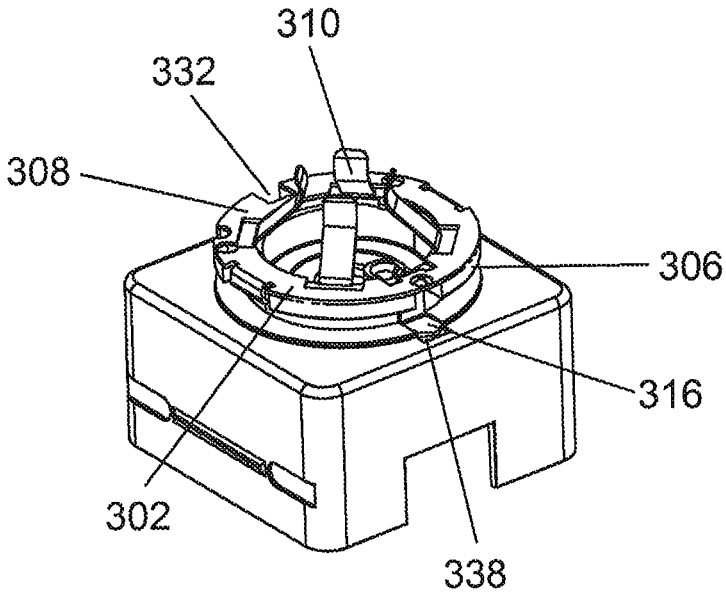
FIG. 9 shows part of a fourth exemplary embodiment of an inventive high-pressure discharge lamp in a perspective view.

FIG. 9 shows a fourth exemplary embodiment of an inventive base-reference ring combination with a plastic base 302, which has an inner base part 306, on the upper rim of which (in FIG. 9) is attached a further variant of an inventive metal reference ring 308. In a similar manner to the reference ring 208 according to FIGS. 7 and 8 it has no welding lugs, but the welding lugs 310 are attached to the inner base part 306 according to the prior art. For the free and contactless assembly of the reference ring 308, four recesses 332 are provided on its inner rim, through which the welding lugs 310 extend from the inner base part 306 to the metal spring clip (not shown).

Figure 10:
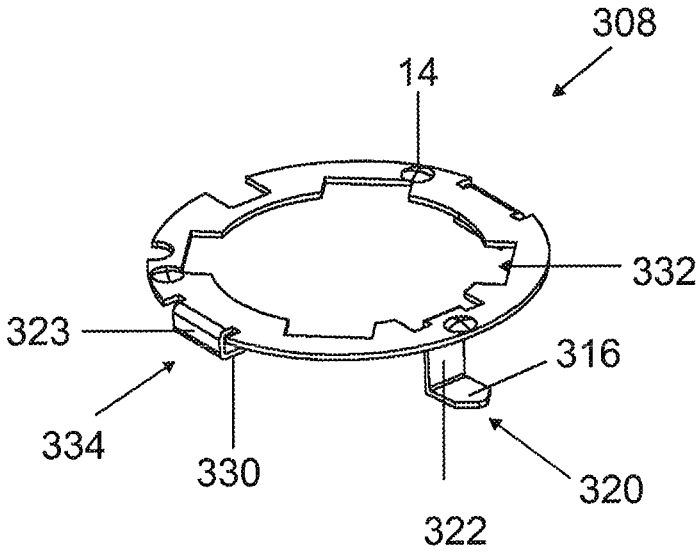
FIG. 10 shows the reference ring of the fourth exemplary embodiment according to FIG. 9 in a perspective view.

FIG. 10 shows the reference ring 308 of the fourth exemplary embodiment according to FIG. 9. On the outer rim it has two oppositely arranged clip fastenings 334. Each clip fastening 334 has an intermediate section 323 extending downwards (in FIG. 10) and a rear grip section 330 connected thereto and directed radially inwards. Furthermore the reference ring 308 has a contact bracket 320 with an intermediate section 322 and a contact section 316 extending radially outwards. In addition the reference ring 308 has three bearing cams 14 evenly distributed on its upper surface, which form the bearing points of the inventive high-pressure discharge lamp in relation to, respectively, a lamp module or vehicle headlight (not shown).

During the assembly of the reference ring 308 according to the fourth exemplary embodiment of the inventive high-pressure discharge lamp, the two rear grip sections 330 of the clip fastening 334 are elastically bent apart. The reference ring 308 in thus set on the inner base part 306 (cf. FIG. 9) and the rear grip sections 330 each engage behind one supporting section (not shown) of the inner base part 306. The two supporting sections are formed as approximately horizontal projections, whose width corresponds approximately to that of the clip fastening 334, wherein the two projections are embodied on opposite sides of the inner base part 306 corresponding to the clip fastenings 334.

In the assembled state of the reference ring 308 its contact section 316 dips into a flat recess 338 of the plastic base 302, so that its upper contact surface lies slightly above the surface of the plastic base 302. When the shielded enclosure (not shown here) is assembled, the contact surface of the contact section 316 comes into electroconductive contact with the shielded enclosure.

Figure 11:
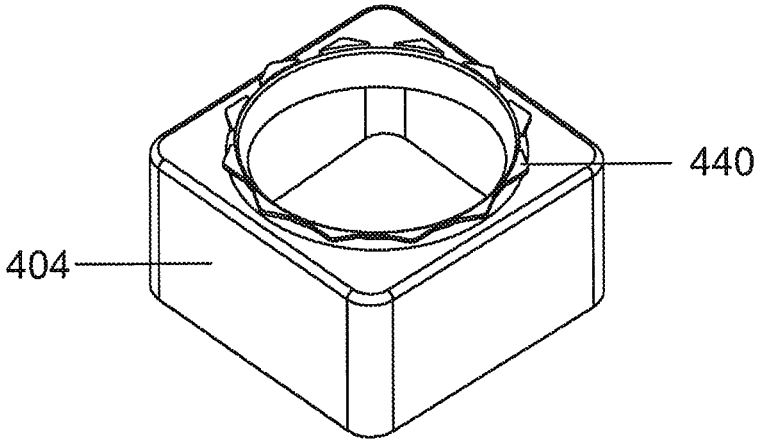
FIG. 11 shows part of a fifth exemplary embodiment of an inventive high-pressure discharge lamp in a perspective view.

FIG. 11 shows a shielded enclosure 404 of a fifth exemplary embodiment of an inventive high-pressure discharge lamp. It has on its (in FIG. 11) upper surface an approximately circular opening, which is penetrated by the inner base part 406 (cf. FIG. 12). On the rim of this opening is provided an annular rim, whose upper edge has twelve projections 440 evenly distributed around the periphery. These projections 440 are embodied as isosceles triangles, which extend approximately radially outwards from the rim of the opening. Their radial length is here less than their width (seen in the peripheral direction of the opening). The projections 440 are formed on one level with the rim and shielded enclosure 404, wherein for manufacture an injection molding method (aluminum/magnesium) is preferable.

Figure 12:
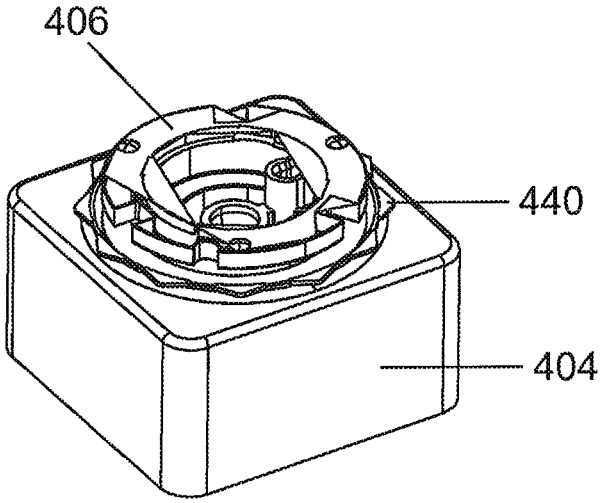
FIG. 12 shows part of the fifth exemplary embodiment according to FIG. 11 in a perspective view.

FIG. 12 shows the shielded enclosure 404 according to FIG. 11 with the inner base part 406 set in the opening. The welding lugs attached to the inner base part 406 are not shown.

In this exemplary embodiment the electroconductive contact between the shielded enclosure 404 and the lamp module or vehicle headlight (not shown) is established via the twelve projections 440, which are in electroconductive contact after the introduction of the high-pressure discharge lamp into the lamp module or vehicle headlight respectively.

Thus, as with the other exemplary embodiments, a Faraday cage is formed, which is required for electromagnetic compatibility (EMC) and is simple to create according to the invention.

Disclosed is a high-pressure discharge lamp with a lamp bulb, which extends along a longitudinal axis of the lamp and is attached to a plastic base, which is essentially surrounded by a metal shielded enclosure.

A first variant of the inventive high-pressure discharge lamp has furthermore a metal reference ring, which is attached to an inner base part of the plastic base, and can be brought into contact with a lamp module or vehicle headlight, wherein the reference ring has at least one contact section, which is in electroconductive contact with the shielded enclosure.

A second variant of the inventive high-pressure discharge lamp likewise has a lamp bulb, which extends along a longitudinal axis of the lamp and is attached to a plastic base, which is essentially surrounded by a metal shielded enclosure. A metal contact collar is provided here, which is embodied on the shielded enclosure and can be brought into electroconductive contact with a lamp module or vehicle headlight.

In all exemplary embodiments and variants of the invention the shielded enclosure is connected, for example, to the ground reference potential of an operating device for the high-pressure discharge lamp via a power supply cable, or, for example, to the electrical ground potential in the vehicle via the headlight reflector or via the vehicle bodywork. The ground reference potential of the operating device and the electrical ground potential in the vehicle can be identical. The ground potential in the vehicle is generally determined by the potential of the negative terminal of the vehicle battery.

The invention claimed is:

1. A high-pressure discharge lamp comprising a translucent lamp bulb, which extends along a longitudinal axis of the lamp and is attached to a plastic base, which is essentially surrounded by a metal shielded enclosure a metal reference ring, which is attached to an inner base part of the plastic base, and is adapted to be brought into contact with a lamp module or vehicle headlight, wherein the reference ring has at least one contact section, which is in electroconductive contact with the shielded enclosure.

2. The high-pressure discharge lamp as claimed in claim 1, wherein the contact section extends approximately radially outwards in relation to the longitudinal axis of the lamp and has a contact surface, which is in electroconductive contact with the shielded enclosure.

3. The high-pressure discharge lamp as claimed in claim 1, wherein the contact section is at least in parts overmolded by the inner base part.

4. The high-pressure discharge lamp as claimed in claim 1, wherein the contact section is at least in parts set into a flat recess of the plastic base.

5. The high-pressure discharge lamp as claimed in claim 3, comprising at least one contact bracket, which has an intermediate section, which is arranged approximately parallel to the longitudinal axis of the lamp, wherein a contact section is provided on each contact bracket.

6. The high-pressure discharge lamp as claimed in claim 5, wherein metal welding lugs are embodied on the reference ring, whose end sections are welded with a metal spring clip surrounding the lamp bulb.

7. The high-pressure discharge lamp as claimed in claim 6, wherein the reference ring has mounting lugs, which are arranged approximately parallel to the longitudinal axis of the lamp and at least in parts are overmolded by the inner base part.

8. The high-pressure discharge lamp as claimed in claim 7, with four welding lugs and with four mounting lugs, which are arranged evenly and in each case in pairs at the same points on the periphery of the reference ring, and with three contact brackets and with an additional intermediate section.

9. The high-pressure discharge lamp as claimed in claim 8, wherein the reference ring is a stamp-bent part, whose contact brackets are embodied by bending outwards away from the direction of the lamp bulb, whose welding lugs are embodied by bending outwards away from the direction of the lamp bulb, and whose mounting lugs and whose additional intermediate section are embodied by bending inwards away from the direction of the lamp bulb.

10. The high-pressure discharge lamp as claimed in claim 5, wherein the shielded enclosure has one half of the enclosure facing towards the lamp bulb and one facing away from the lamp bulb, and wherein the contact surfaces, which are arranged on the outer end section of the side of each contact section facing towards the lamp bulb, are in contact with the half of the enclosure facing towards the lamp bulb.

11. The high-pressure discharge lamp as claimed in claim 5, wherein the inner base part has a flange arranged approximately perpendicular to the longitudinal axis of the lamp, which is riveted to the shielded enclosure, wherein each contact section is arranged on the side of the flange facing away from the lamp bulb, and wherein the contact surfaces are provided on the side of each contact section facing away from the lamp bulb.

12. The high-pressure discharge lamp as claimed in claim 1, wherein four metal welding lugs are distributed and fixed evenly on the periphery of the inner base part, which extend from the inner base part in the direction of the lamp bulb, and whose end sections are welded with a metal spring clip surrounding the lamp bulb.

13. The high-pressure discharge lamp as claimed in claim 12, wherein four recesses are arranged evenly on the inner rim of the reference ring, through which the welding lugs extend from the inner base part to the metal spring clip.

14. The high-pressure discharge lamp as claimed in claim 1, wherein the reference ring has a spacer ring on its outer rim and on its side facing away from the glass bulb, on whose rim facing away from the lamp bulb are attached a multiplicity of evenly distributed bent brackets, wherein each bent bracket engages behind a surrounding projection of the inner base part with a rear grip section directed approximately radially inwards, and wherein each bent bracket has an intermediate section arranged approximately parallel to the longitudinal axis of the lamp and a contact section directed approximately radially outwards.

15. The high-pressure discharge lamp as claimed in claim 1, wherein the reference ring has at least one clip fastening, which has an intermediate section arranged approximately parallel to the longitudinal axis of the lamp and a rear grip section connected thereto and directed approximately radially inwards, which engages behind a supporting section of the inner base part.

16. The high-pressure discharge lamp as claimed in claim 15, wherein the reference ring has two clip fastenings on oppositely located peripheral sections, and the inner base part accordingly has two supporting sections, wherein the reference ring has a contact bracket arranged between the clip fastenings, which has an intermediate section arranged approximately parallel to the longitudinal axis of the lamp and a contact section directed approximately radially outwards.

17. The high-pressure discharge lamp as claimed in claim 1, wherein the inner base part corresponds to the IEC 60061-1 PREFOCUS CAPS PK32d Standard mentioned in the ECE Regulation No. 99.

18. The high-pressure discharge lamp as claimed in claim 1, wherein the reference ring has bearing cams evenly distributed on the periphery, which can be brought into contact with the lamp module or vehicle headlight.

19. A high-pressure discharge lamp with a lamp bulb, which extends along a longitudinal axis of the lamp and is attached to a plastic base, which is essentially surrounded by a metal shielded enclosure and a metal contact collar, which is embodied on the shielded enclosure and can be brought into electroconductive contact with a lamp module or vehicle headlight, wherein the contact collar has projections evenly distributed on the periphery of the contact collar, which in each case have a triangular form and extend radially outwards.

* * * * *